United States Patent [19]

Payne

[11] Patent Number: 4,473,732

[45] Date of Patent: Sep. 25, 1984

[54] POWER CIRCUIT FOR INDUCTION COOKING

[75] Inventor: Thomas R. Payne, Louisville, Ky.

[73] Assignee: General Electric Company, Louisville, Ky.

[21] Appl. No.: 550,729

[22] Filed: Nov. 14, 1983

Related U.S. Application Data

[63] Continuation of Ser. No. 223,193, Jan. 7, 1981, abandoned.

[51] Int. Cl.[3] ..... H05B 6/06

[52] U.S. Cl. ..... 219/10.77; 219/10.49 R; 363/133

[58] Field of Search ..... 219/10.49, 10.77, 10.75; 363/37, 97, 131, 132, 133, 134

[56] References Cited

U.S. PATENT DOCUMENTS

| | | | |
|---|---|---|---|
| 3,383,582 | 5/1968 | Bishop et al. | 363/37 |
| 3,452,214 | 6/1969 | Martin | 307/96 |
| 3,519,917 | 7/1970 | Martin | 323/23 |
| 3,665,503 | 5/1972 | Wheaton | 363/133 |
| 3,702,434 | 11/1972 | Ryan | 323/20 |
| 3,781,503 | 12/1973 | Harnden, Jr. et al. | 219/10.49 |
| 3,973,165 | 8/1976 | Hester | 315/105 |
| 4,074,101 | 2/1978 | Kiuchi et al. | 219/10.49 |
| 4,147,910 | 4/1979 | Kiuchi et al. | 219/10.49 |

*Primary Examiner*—Roy N. Envall, Jr.
*Assistant Examiner*—M. M. Lateef
*Attorney, Agent, or Firm*—H. Neil Houser; Radford M. Reams

[57] ABSTRACT

An induction heating arrangement adapted for energization by a pulsating power supply of relatively low frequency is provided, in which an induction heating coil is coupled to the power supply by a pair of power transistors arranged for push-pull operation. Alternately switching each of the power transistors into conduction causes current pulses of opposite direction to alternately flow in the coil. The transistors are arranged to switch at a frequency which is high relative to the frequency of the power supply and which varies directly with the instantaneous amplitude of the power supply voltage. The amplitude of the current pulses varies directly with the instantaneous amplitude of the power supply and the duration of the pulses varies inversely with amplitude of the power supply with the result that the amount of energy delivered to the coil by each current pulse is essentially uniform from pulse to pulse.

12 Claims, 19 Drawing Figures

OSC

OSCD $\overline{OSC}$ $\overline{OSCD}$ $\overline{OSCD}$ $\overline{\overline{OSCD}}$ $PV_{B1}$ $PV_{B2}$

COIL CURRENT

POWER CIRCUIT FOR INDUCTION COOKING

This application is a continuation of application Ser. No. 223,193, filed Jan. 7, 1981, now abandoned.

BACKGROUND OF THE INVENTION

This invention relates generally to induction heating arrangements and, more particularly, to power circuits for induction cooking appliances. Induction cooking is attractive for domestic use because the use of induction heating to heat a cooking utensil is a theoretically efficient process. Heat is generated only in the metallic utensil where it is wanted. The ordinary gas range and electric range, by comparison, have greater losses due to poor coupling of heat to the utensil and heating the surrounding atmosphere. However, the frequency of power supplies available in the home, generally on the order of 50 to 60 Hz, is too low to effectively drive an induction heating coil. For cooking appliances, ultrasonic frequencies on the order of 20 KHz provide much more satisfactory results.

Inverter circuits commonly employed in induction cooking appliances to convert the 60 Hz line voltage to the high-frequency signal for driving the induction coil use filtered LC resonant circuits to provide the desired ultrasonic frequency signal. Examples of such inverter circuits may be found in U.S. Pat. No. 3,781,503 to Harnden, Jr. et al and U.S. Pat. No. 4,074,101 to Kiuchi et al. In the LC resonant circuits used in such resonant circuit inverters, the effective inductance becomes quite large due to the induction heating coil of the power circuit. Because of this large inductance a large capacitance is required. In addition to the capacitance required for the resonant circuit, a smoothing capacitor is required to filter the rectified line voltage. This capacitor also in necessarily large. The large capacitors required for such circuits are expensive to the extent that the cost of the capacitors becomes the dominant cost of the power circuit.

Alternatives to resonant circuit inverters include inverter circuits of the push-pull type which typically include a transformer having a center tap winding with the ends of the primary windings connected to switching devices driven in push-pull. Such push-pull arrangements conventionally employ a feedback circuit including a feedback transformer to sense load current and control the frequency of the switching device in accordance with sensed load current. Examples of such inverter circuits are disclosed in U.S. Pat. No. 3,383,582 to John D. Bishop et al and U.S. Pat. No. 3,973,165 to Thomas Eugene Hester. The feedback transformer and other circuit elements employed in such feedback circuitry are prohibitively expensive, making such circuits relatively unattractive for cooking appliance applications.

In view of the shortcoming of the prior art, it is apparent that there is a need for a power circuit for an induction cooking appliance which eliminates the costly capacitance associated with the resonant circuit inverters and which eliminates the costly transformer feedback arrangements associated with push-pull inverters of the prior art.

It is therefore an object of the present invention to provide an induction heating arrangement in which an induction heating coil is energized by a pulsating power supply and in which energization of the coil is controlled by switch means operative to cause the direction of current in the induction heating coil to oscillate at a frequency which is independent of load current.

It is a further object of the present invention to provide an induction heating arrangement of the above mentioned type in which the switch means is operative to cause the direction of current in the induction coil to oscillate at a frequency which varies directly with the amplitude of the power supply.

It is a further object of the present invention to provide an induction heating arrangement of the above mentioned type in which the energy delivered to the coil with each current pulse is uniform from pulse to pulse.

It is a further object of the present invention to provide an induction heating arrangement of the above mentioned type which eliminates the need for large costly capacitors and costly transformer feedback circuitry.

SUMMARY OF THE INVENTION

In accordance with the present invention, an induction heating arrangement adapted for energization by a pulsating power supply of relatively low frequency is provided.

An induction heating coil is coupled to the power supply by switch means switchable between first and second conduction modes. In the first conduction mode, switch means couples the power supply to the coil so as to cause current from the power supply to flow in the coil in one direction. In the second conduction mode, the switch means couples the power supply to the coil so as to cause current to flow in the coil in the opposite direction. Control signal generating means generates a control signal which oscillates between a first state and a second state at a frequency which is high relative to the frequency of the power supply and which is independent of load current.

In a preferred form of the invention, the frequency of oscillation of the control signal varies directly with the amplitude of the power supply. The control signal is coupled to the switch means and operative to oscillate the switch means between its first and second conduction modes as the control signal oscillates between its first and second states, respectively. By coupling the power supply to the coil in this manner, the direction of current in the coil oscillates at a frequency which varies directly with the instantaneous amplitude of the power supply. The resultant current in the coil comprises a train of alternate current pulses of opposite direction. The magnitude of each pulse varies directly with the instantaneous amplitude of the power supply and the duration of each pulse varies inversely with the amplitude of the power supply. Consequently, the energy delivered to the coil by each pulse, which is proportional to the product of the amplitude and duration of the pulse, is essentially uniform from pulse to pulse.

In the illustrative embodiment herein described, the induction coil is a center tapped coil which is coupled to the power supply by switch means comprising a pair of power transistors arranged for push-pull operation. A voltage controlled oscillator generates a control signal having a frequency which varies directly with the instantaneous magnitude of the power signal. This control signal is converted by logic circuitry into a pair of driving signals for driving the transistors in push-pull fashion at a switching rate corresponding to the frequency of the control signal. The logic circuitry introduces momentary time delays between the switching OFF of one transistor and the switching ON of the other transistor to permit dissipation of reverse current in the coil.

The efficiency of the power circuit of the illustrative embodiment is enhanced by holding both transistors in concurrent non-conduction modes when the magnitude of the power signal is less than a predetermined threshold level such as during the first 30° and last 30° of each power signal cycle.

DETAILED DESCRIPTION OF THE INVENTION

Figure 1:
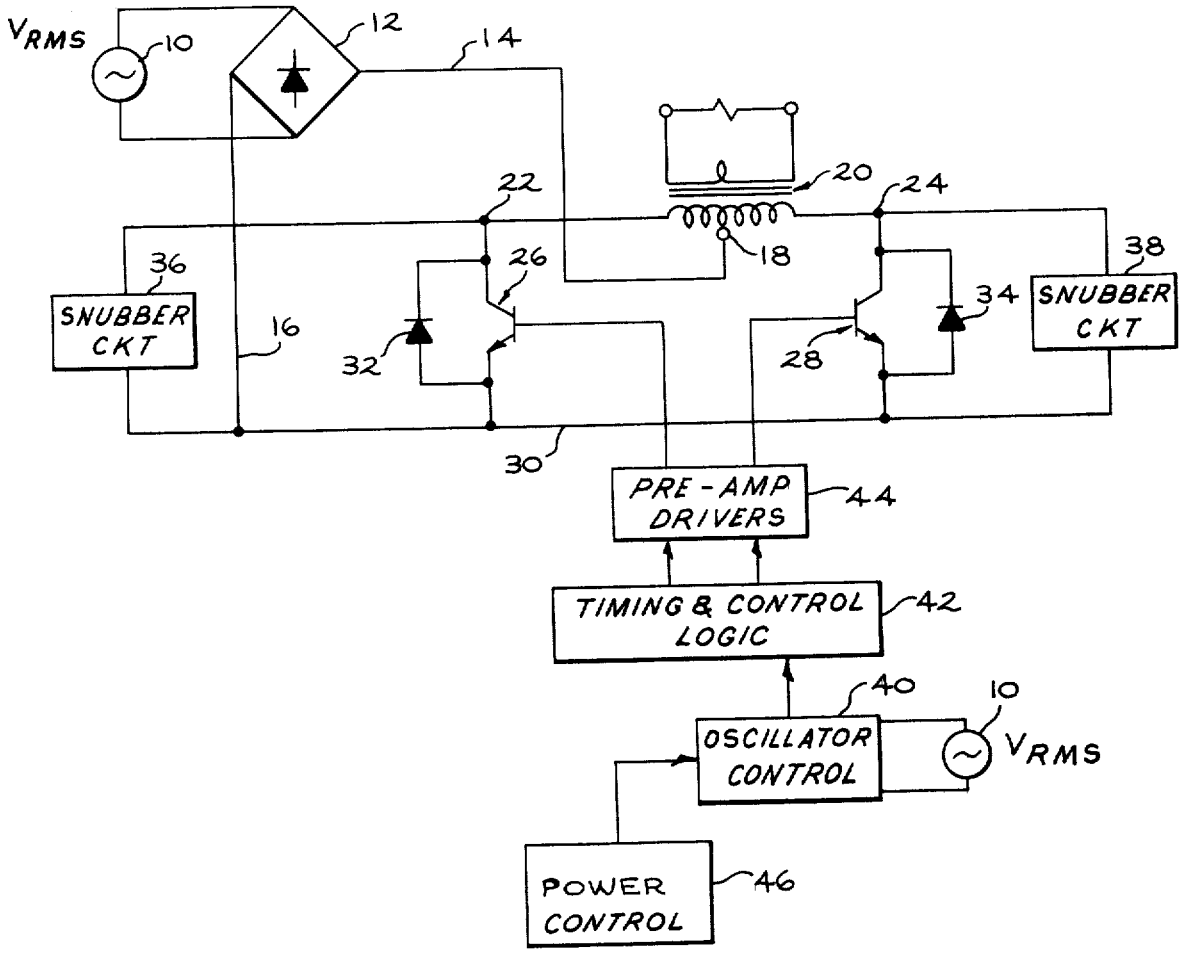
FIG. 1 is a simplified schematic diagram of a power circuit for an induction cooking appliance illustratively embodying the induction heating arrangement of the present invention.

The induction heating arrangement of the present invention is applicable to a variety of inductive heating applications; however, it will be described herein with reference to an induction cooking appliance such as an induction surface unit for a range or a portable cooking or food warming appliance applications for which it is particularly advantageous. Typically, in such an appliance an induction heating coil is appropriately mounted in a horizontal position immediately below a non-metallic supporting surface commonly referred to as the cooking surface which may be made of a thin sheet of glass, ceramic or plastic. This cooking surface supports the cooking utensil to be heated. The cooking utensil, a cooking pot or pan, is typically made of iron.

Energy for heating the utensil is transferred to the utensil from the coil by driving the induction heating coil at ultrasonic frequencies to generate a high frequency alternating magnetic field. The magnetic flux emanating from the coil inductively couples the utensil. The utensil may be considered to function as a single-turn secondary winding with a series resistance load, the magnitude of the resistance representing the resistive part of the eddy current and hysteresis losses in the utensil. The current and voltage induced in the utensil can be estimated to a first order of approximation by the transformer laws.

According to the present invention, the induction heating coil is adapted for energization by a relatively low frequency pulsating power supply. Non-resonant push-pull inverter circuit means are provided to couple the pulsating power signal from the power supply to the coil. The inverter circuit means inclues switch means arranged in such a manner that current pulses of opposite direction alternately flow in the coil at a pulse repetition rate which is high relative to the frequency of the power signal, preferably in the ultrasonic range. The current pulse repetition rate is determined by the switching rate of the switch means. Means are provided to generate a control signal for switching the switch means at a rate which is independent of current flow in the coil.

In a preferred form of the invention, the control signal generating means generates a control signal for switching the switch means at a rate which varies directly with the magnitude of the power supply. By this arrangement, when the instantaneous voltage of the power supply is low the switching rate is low, resulting in a relatively long ON time for the coil in each direction. Since the power supply voltage is low, the rate of current buildup in the coil is relatively slow and the longer ON time allows sufficient current buildup to deliver the desired amount of energy to the coil. Similarly, when the instantaneous voltage of the power signal is high which causes rapid current buildup in the coil, the switching rate is also high, resulting in a relatively short ON time for the coil in each direction to prevent current buildup in excess of circuit component limits. The energy delivered to the coil during each current pulse is proportional to the product of the magnitude and the duration of the coil current pulse. Varying switching frequency directly with the magnitude of the power supply varies the pulse duration inversely with the magnitude of the current pulse. By varying the switching frequency in this way, the product of the magnitude and duration is essentially constant, resulting in the amount of energy delivered to the coil with each current pulse being relatively uniform from current pulse to current pulse.

Figure 2A:
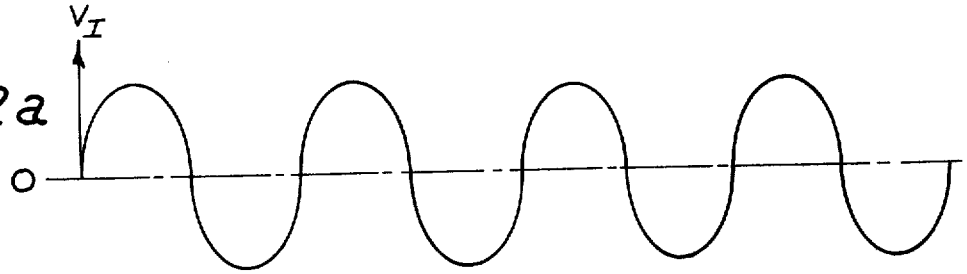
FIG. 2*a* illustrates the voltage waveform of the input power signal for the circuit of FIG. 1.
Figure 2B:
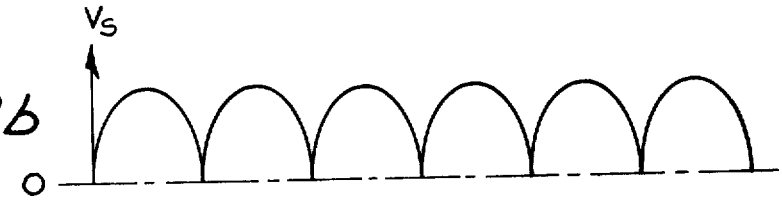
FIG. 2*b* illustrates the voltage waveform of the power signal, $V_s$, applied to the input tap of the induction coil of the circuit of FIG. 1.

In the illustrative embodiment of the present invention shown in simplified schematic form in FIG. 1, the pulsating power supply 10 is a 60 Hz 120 v AC power supply such as is typically available in the home. The alternating current input signal $V_I$ provided by the power supply illustrated in FIG. 2*a* is rectified by a conventional diode bridge 12. The output signal $V_s$ from bridge 12 is an unfiltered fully rectified pulsating power signal such as shown in FIG. 2*b*. Hot line 14 connects the active output terminal of bridge 12 to the center tap 18 of induction heating coil 20. The end terminals 22 and 24 of coil 20 are connected to the collectors of power transistors 26 and 28, respectively. Transistors 26 and 28 are arranged to function as switch means for coupling power signal $V_s$ to coil 20. The emitters of transistors 26 and 28 are connected to ground line 16 to switchably couple terminals 22 and 24 to ground line 16. Normally reverse biased protective diodes 32 and 34 are arranged in parallel with transistors 26 and 28, respectively, to provide a path for transient reverse current in the coil when the transistors switch out of conduction. Conventional RC snubber circuits 36 and 38 clamp the voltage at the collectors of transistors 26 and 28 below the breakdown voltage for protection against inductive spikes.

The switch means comprising transistors 26 and 28 is switchable between a first conductive mode in which transistor 26 is conductive and transistor 28 is non-conductive; a second conductive mode in which transistor 26 is non-conductive and transistor 28 is conductive; and a non-conductive mode in which both transistors are non-conductive. By this arrangement, when the switch means is in its first conductive mode, the current flows in one direction through the coil from center tap 18 to terminal 22. When the switch means is in its second conductive mode, current flow through the coil is in the opposite direction from center tap 18 to terminal 24. By oscillating the switch means between its first and second conductive modes, current pulses of opposite direction relative to the coil alternately flow in the coil. When operated in this manner, the frequency at which coil 20 is driven is determined by the switching rate of transistors 26 and 28.

Figure 3:
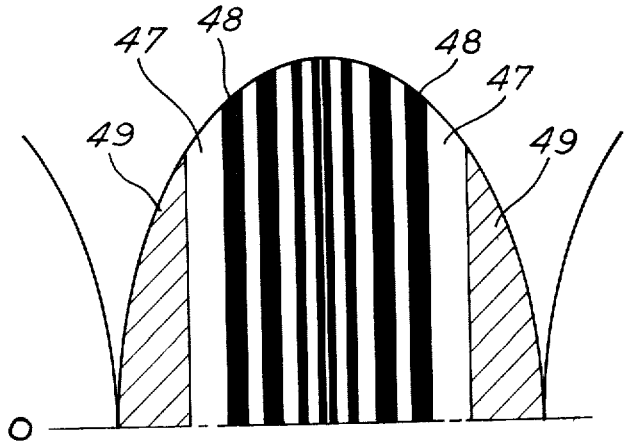
FIG. 3 is an enlarged exaggerated illustration of one conductive cycle of $V_s$ with the operating modes of the power transistors of FIG. 1 superimposed thereon to illustrate the manner of operation of the power circuit of FIG. 1.

This switching rate is controlled by control signal generating means 40 which monitors the AC signal from power supply 10 and generates a control signals having a frequency which varies directly with the magnitude of the power signal $V_s$ in a manner to be described with reference to FIG. 3. The control signal from block 40 is split into two logic signals by logic and timing means 42, one signal for each transistor. Each logic signal is then amplified by the pre-amp driving circuit of block 44. The resulting trigger signals from block 44 are coupled to the base of their associated transistors. This arrangement of power transistors 26 and 28 controls signal generating means 40, and logic timing means 42 provides non-resonant push-pull inverter circuit means for controlling energization of heating coil 20.

In the circuit of FIG. 1, the magnitude of the instantaneous current in the load is determined by the magnitude of the instantaneous voltage $V_s$ applied to center tap 18 and the length of time each of transistors 26 and 28 is conductive. If the switching frequency of the transistors is too low, current in the coil can exceed the operating limits of the circuit components. If the switching rate is too high, current buildup in the coil will be insufficient to deliver sufficient energy to the coil to permit adequate heating of the inductive load. Thus, to use a constant switching frequency in the circuit of FIG. 1, the frequency selected must be high enough to limit current buildup in the coil at high values of $V_s$ to acceptable levels and low enough to provide the desired heating performance. Depending on the output heating requirements of the induction heating arrangement, switching rates high enough to limit current buildup at high values of $V_s$ may not permit sufficient current buildup at low values to deliver sufficient energy to provide adequate heating of the load.

It was found that operation of the coil of the illustrative embodiment at a constant frequency of 20 KHz permits too much current buildup in the circuit when $V_s$ is near its peak value. Operation at higher frequencies on the order of 30 KHz satisfactorily limits current buildup when $V_s$ is high, but does not allow sufficient current buildup when $V_s$ is low to provide the heating performance desired for cooking.

One approach which would provide sufficient heating while switching at a fixed or constant frequency and which is technically feasible though unattractive from a cost standpoint would be to filter the output from bridge 12 so that $V_s$ is essentially a smoothed DC signal. The switching frequency could then be set high enough to limit the current without concern over insufficient current buildup during low portions of $V_s$.

The preferred approach for overcoming the difficulty presented by a constant switching frequency, in accordance with one aspect of the present invention, is to vary the driving frequency, i.e., the switching rate, directly with the magnitude of the power signal $V_s$. In this way, the coil runs at a relatively low frequency, i.e., a relatively long ON time at low values of $V_s$ and at high frequency, i.e., a relatively short ON time, as $V_s$ nears its peak value. By increasing the ON or conductive time for each transistor for low $V_s$ and decreasing the ON time for high $V_s$, the energy delivered to the coil during each ON time, which is a function of the product of the magnitude of the current pulse and the duration or width of the current pulse, is essentially uniform from pulse to pulse.

As seen in FIG. 2b, the power signal $V_s$ applied at center tap 18 is a fully rectified unfiltered 120 Volts RMS pulsating at a frequency of 120 Hz, with each power signal cycle being of 8.3 millisecond duration. Coil 20 is driven at a frequency in the ultrasonic range by alternately switching transistors 26 and 28 ON and OFF on the order of 200 times each during each 8.3 millisecond power signal cycle. FIG. 3 provides an enlarged out of scale illustration of a single half cycle of the power signal $V_s$. The light portions 47 represent periods when transistor 26 is ON and transistor 28 is OFF; the shaded portions 48 represent periods when transistor 28 is ON and transistor 26 is OFF. The cross-hatched regions 49 represent periods of total non-conduction during which both transistors are concurrently non-conductive. The purpose for these periods will be described further on. The pulse widths within the conductive portion of the 8.3 millisecond envelope are greatly exaggerated out of scale to clearly illustrate that as the amplitude of $V_s$ increases the ON time for both transistors proportionally decreases. In reality, in the illustrative embodiment the duration of ON time for each transistor varies from a minimum of roughly 15 microseconds for $V_s$ near its peak to a maximum of roughly 25 microseconds when $V_s$ is at its minimum value within the conductive portion of the 8.3 millisecond power signal cycle, i.e., at the beginning and at the end of the conductive portion of the cycle.

Figure 2C:
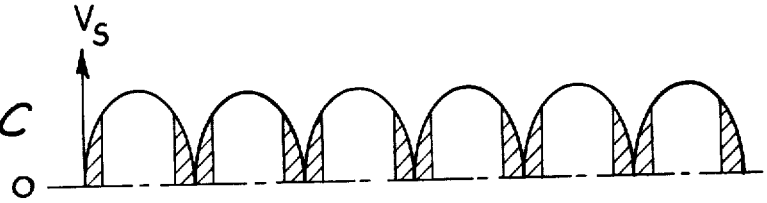
FIGS. 2*c*–2*e* illustrate conduction cycle repetition rates for the power circuit of FIG. 1, for various operator selected power settings.

The periods of concurrent non-conduction at the beginning and end of each power signal cycle enhance the operating efficiency of the circuit. A significant advantage of the present invention is that it permits use of an unfiltered power signal, thereby eliminating the need for costly filter elements. It is well known that inverter power circuits operate at higher efficiencies at high $V_s$ values such as when $V_s$ is held up by a filter capacitor during the low portions of the line voltage. However, such capacitors, in addition to being expensive components, lower the power factor of the circuit. By operating unfiltered, the power factor for the power circuit is kept relatively high. The low operating efficiency at low values of $V_s$ is countered by holding both transistors in the non-conductive mode concurrently for a predetermined period at the beginning and at the end of each cycle of the power signal $V_s$ to prevent energization of the coil when the magnitude of the power signal $V_s$ is too low for efficient circuit operation. As shown in FIG. 2c and FIG. 3 where the cross-hatched portions represent periods of non-conduction, in the illustrative embodiment a delay angle on the order of 30° and a conduction angle on the order of 150° is employed to prevent current flow in the coil during the first and last 30° of each cycle when $V_s$ is undesirably low.

Figure 2D:
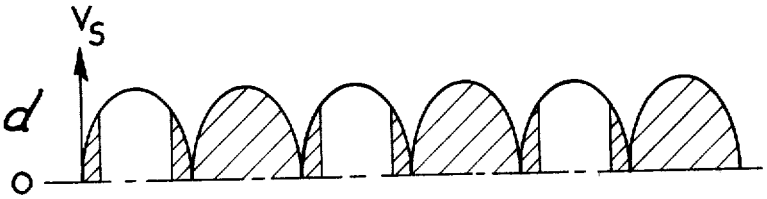
Figure 2E:
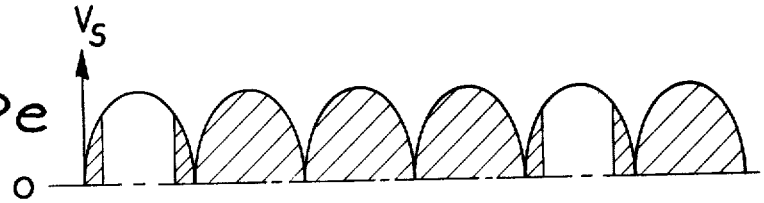

Control of output power, that is, control of the energy delivered to the utensil in accordance with operator selected power settings, is implemented by counting cycle of the power signal and in effect periodically rendering the transistors concurrently non-conductive for complete cycles of the power signal. The rate at which the transistors are rendered non-conductive for complete power cycles, or viewed the other way around the repetition rate for conductive cycles is set in accordance with the power setting selected by the user. Conductive repetition rates for various power settings are illustrated in FIGS. 2*c*–2*e* where waveforms representing the power signal $V_s$ of FIG. 2*b* are superimposed with cross-hatching to identify those periods during which no current flows in coil 20 because both transistors 26 and 28 are in their non-conductive modes. FIG. 2*c* illustrates a conductive cycle repetition rate of 1/1 in which there are no fully non-conductive cycles. This corresponds to a power setting of 100%. In FIG. 2*d* every other cycle is non-conductive, and in FIG. 2*e*, 3 of 4 cycles are non-conductive providing conductive cycle repetition rates of ½ and ¼, respectively, corresponding to power settings of 50% and 25%, respectively. The output of power setting control block 46 is a logic signal, which is generated for each power signal cycle to set the repetition rate in accordance with the power setting selected by the user. The logic signal assumes a first logic state to initiate conductive cycles and a second logic state to initiate non-conductive cycles. An arrangement for generating such signals to control the output power of a conventional heating element is disclosed in detail in commonly assigned, copending application for U.S. Pat. Ser. No. 008,360, filed Feb. 1, 1979, the specification of which is hereby incorporated by reference. This signal is provided to block 40 as an input used in generating a control signal for controlling the switch rate of transistors 26 and 28.

Figure 4:
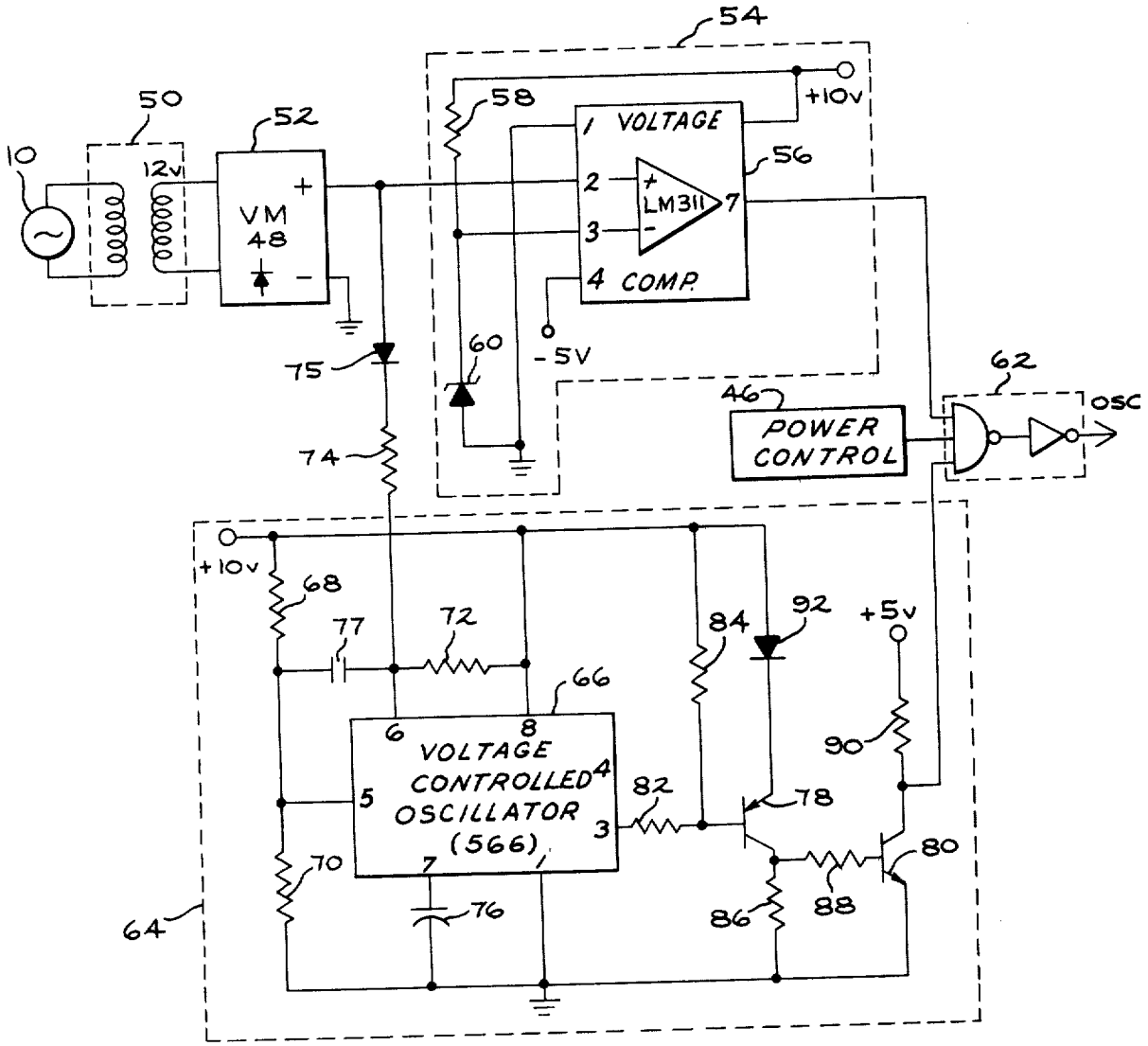
FIG. 4 is a simplified schematic circuit diagram illustrating the circuitry of block 40 of FIG. 1.

Circuitry employed in block 40 of the illustrative embodiment of FIG. 1 is shown in schematic form in FIG. 4. The circuit of FIG. 4 generates a square wave control signal, OSC, which performs essentially three functions: disables current flow in the coil at the beginning and the end of each cycle of the power signal $V_s$ to enhance operating efficiency; oscillates at a frequency proportional to the magnitude of signal $V_s$ when the magnitude of $V_s$ is above a predetermined threshold value to set the switching rate of transistors 26 and 28; and responds to the operator power level selection signal from block 46 to provide the conductive cycle repetition rate corresponding to the selected power setting for the coil.

The circuit of FIG. 4 is coupled to the 120 volt 60 Hz AC power supply 10 via step down signal transformer 50 which steps the voltage down from 120 V RMS to 12 V RMS. Transformer 50 may be of the type readily commercially available and identifiable by the designator PC-12-100. The AC output signal from transformer 50 is rectified by full wave rectifier 52 which can be a readily available IC chip identified by the designator VM 48. Rectifier 52 produces a signal $V_s'$ which is in phase with and proportional in magnitude to power signal $V_s$. $V_s'$ is applied to chopper circuit 54 and oscillator 56.

Chopper circuit 54 sets the delay and conduction angles for $V_s$ by preventing the control signal, OSC, from switching transistors 26 and 28 into conduction by holding OSC in a non-oscillating state when the output signal from bridge 52, $V_s'$, is less than a predetermined threshold value corresponding to $V_s$ being less than a predetermined threshold value. It is this threshold value of $V_s'$ which effectively sets the delay and conduction angles for $V_s$ which, as previously described with reference to FIG. 3, are preferably set at 30° and 150°, respectively. $V_s'$ is coupled to the positive input of a voltage comparator 56 which may be an IC chip readily commercially available and identifiable by the designator LM 311. Voltage comparator 56 has its negative input tied to a voltage biasing network which includes resistor 58 in series with zener diode 60 and which is fed by a DC logic voltage source of +10 volts DC. In this circuit, the value of the zener voltage, $V_z$, is the predetermined threshold voltage which sets the delay and conduction angle for $V_s$. Selection of zener voltage at $V_z=3.3$ volts sets the delay and conduction angles at approximately the desired 30° and 150°, respectively. The output signal from comparator 54 is applied as one input of the TTL AND circuit 62 where it functions as an enable signal.

When $V_s'$ is in a portion of its cycle in which its magnitude is less than 3.3. volts, corresponding to both $V_s'$ and $V_s$ being in that portion of the cycle between 0° and 30° or between 150° and 180° the output of comparator 56 is a logical zero, thereby holding OSC, the output of AND circuit 62, in a non-oscillating low state and preventing the triggering of transistors 26 and 28 during such periods. When $V_s'$ is greater than 3.3 volts corresponding to $V_s$ being in the portion of its cycle between 30° and 150°, the output of comparator 56 is high permitting the output signal of AND circuit, 62, OSC, to swing in accordance with the other gate inputs.

The signal which determines the switching rate of the transistors during the conductive portions of the power cycle is provided by oscillator circuit 64 which generates an output signal having a frequency which is directly and linearly proportional to $V_s'$ and, consequently, to $V_s$. This function is performed in circuit 64 by a voltage controlled oscillator 66 which may be an integrated circuit available commercially as an eight pin dual inline package numbered 566 (SN566, LM566, etc., depending upon the manufacturer). Normally, when using the 566 IC as a voltage controlled oscillator, a fixed bias is applied to pin 6 and the modulating input is applied to pin 5. However, in such a configuration, the usable voltage range for pin 5 is limited to the range of 75%–100% of the supply voltage. To avoid this limitation on the swing of the modulating voltage which in FIG. 4 is $V_s'$, which swings for 0 volts to approximately 16.8 volts, pin 5 is used as the fixed bias point and pin 6 as the modulating point.

Pin 5 is biased to a DC voltage by resistors 68 and 70 fed by DC voltage source of +10 volts, and held at that voltage. Pin 6 is tied to a DC bias point by connection of resistor 72 between pin 8 and pin 6 with DC bias voltage of +10 volts applied to pin 8. Pin 6 is also tied to the positive output of rectifier 52 via resistor 74 which function as a modulating current source sending a current of variable magnitude to pin 6. The magnitude of the current supplied to pin 6 from this current source varies directly with $V_s'$. Diode 75 connected in series with resistor 74 blocks current from the 10 Volts DC source through resistor 74 when $V_s'$ is low. Capacitor 77 connected between pin 5 and pin 6 functions as a high frequency bypass filter.

Timing capacitor 76 is connected from pin 7 to ground. The frequency of the oscillator output signal at pin 3 is determined by the rate at which capacitor 76 is charged. When $V_s'$ is zero, there is no modulating current from the current source to pin 6. The frequency of the output signal under this condition is determined solely by the timing resistor 72 and capacitor 76. When $V_s'$ is not zero, additional charging current is delivered to pin 6 proportional to the value of $V_s'$. As this current increases, the charging time for capacitor 76 decreases proportionally, causing the frequency of the output signal to increase proportionally. As this current decreases, the charging time increases and the frequency decreases. For resistor 72 at 3.3 K ohms and capacitor 76 at 0.006 uF, the constant unmodulated frequency, i.e. the output frequency for $V_s'$ equal to zero volts, is approximately 10 KHz. For $V_s'$ equal to its peak value of approximately 16.8 volts, the output frequency is roughly 30 KHz. Thus, the frequency of the output signal from pin 3 varies from 10 KHz to 30 KHz as $V_s$ varies from zero to its peak value. At the start of the conductive portion of the 8.3 millisecond envelope the value of the modulated frequency from pin 3 has already increased by 10 KHz, so the OSC frequency varies between 20 KHz and 30 KHz across the conductive portion of $V_s$.

The PNP-NPN circuit comprising transistors 78 and 80, biasing resistors 82, 84, 86, 88 and 90, and diode 92 re-biases the square wave output from pin 3 of oscillator 66 to TTL voltage levels. The collector voltage of transistor 80 which oscillates at the frequency of the output signal at pin 3 is applied as an input to AND circuit 62. During the conductive portions of each power cycle, the control signal OSC oscillates at the frequency of the signal at pin 3.

The remaining input to AND circuit 62 is derived from power control means 46. Block 46 responds to the operator power setting by generating a high signal for conductive power signal cycles and a low signal during power signal cycles which are to be non-conductive, in order to control the power output of coil 20 in accordance with the power setting selected by the operator. Thus, when block 46 dictates a non-conductive power signal cycle, OSC, the output of AND circuit 62 is held in a low non-oscillating state which holds transistors 26 and 28 in their non-conductive modes.

The parameters for the components of the circuit of FIG. 4 are listed in TABLE I.

TABLE I

| | | | |
|---|---|---|---|
| Resistor 56 | 5K | Resistor 88 | 5K |
| Resistor 68 | 1.5 | Resistor 90 | 5K |
| Resistor 70 | 10K | Capacitor 76 | .01 μE |
| Resistor 72 | 3.3K | Capacitor 77 | .001 μF |
| Resistor 74 | 3.9K | Zener Diode 55 | 3.3 volts |
| Resistor 82 | 5K | Transistor 78 | 2N29O7 |
| Resistor 84 | 10K | Transistor 80 | 2N2222 |
| Resistor 86 | 10K | | |

As an alternative to the control signal generating means 40 (FIG. 1) illustratively embodied in the circuit of FIG. 4, logic circuitry or a microprocessor could be used to generate the control signal OSC. In one such arrangement, a pulse generator is adapted to generate timing pulses at a constant repetition rate which is high relative to the desired frequency range for the control signal, and a digital counter to count the timing pulses. A zero crossing detector responsive to the pulsating power supply generates a count initiating pulse with each zero crossing of the power supply which resets the counter. Since the power signal $V_s$ is not filtered, and is in phase with the power supply, and the count is referenced to the zero crossing of the supply, the amplitude of $V_s$ which is a rectified replica of the power supply is predictable at each count. By appropriate logic circuitry or microprocessor programming, each transition of the control signal between its first and second states can be programmed to occur at a predetermined count. Thus, the desired periods of concurrent non-conduction, as well as the desired relationship between current pulse duration or ON time and the amplitude of the supply, are provided by programming each transition of the control signal OSC to occur at the appropriate count.

The logic and timing control circuitry represented as block 42 in FIG. 1 will now be described. As described with reference to FIG. 1, transistors 26 and 28 are alternately conductive. However, it is necessary after turning OFF either power transistor to momentarily hold both transistors OFF to allow the reverse current in the coil to be dissipated. The logic and timing network responds to the control signal OSC from oscillating means 40 (FIG. 1) to generate a pair of timing signals with appropriate time delays for switching the power transistors ON and OFF at a switching rate corresponding to the oscillating frequency of OSC. The logic circuit of block 42 for the illustrative embodiment of FIG. 1 is illustrated schematically in FIG. 5.

Figure 5:
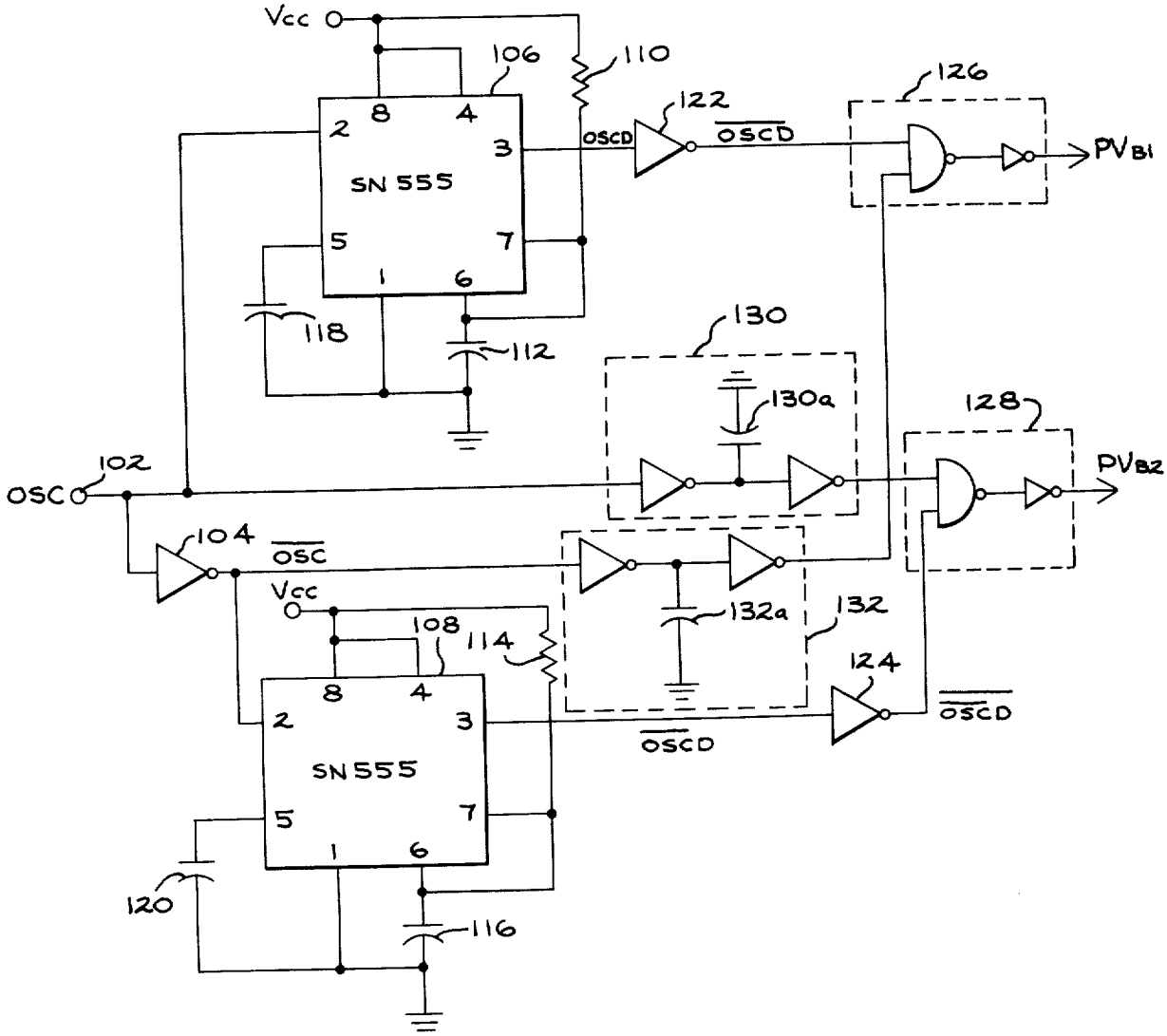
FIG. 5 is a simplified schematic circuit diagram illustrating the circuitry of block 42 of FIG. 1.
Figure 6A:
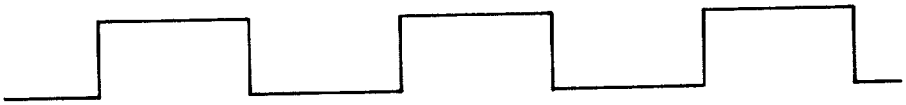
FIGS. 6*a*–6*h* illustrate input, output and various internal logic signals for the circuit of FIG. 5.
Figure 6B:
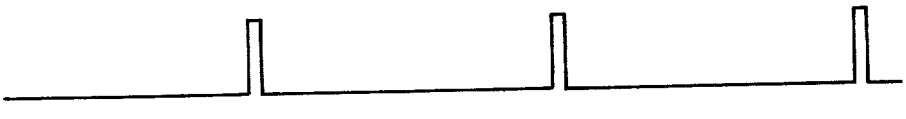
Figure 6C:
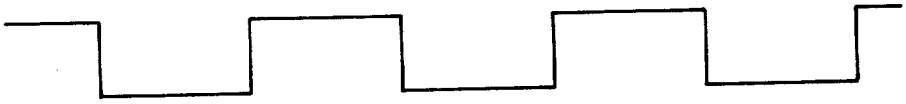
Figure 6D:
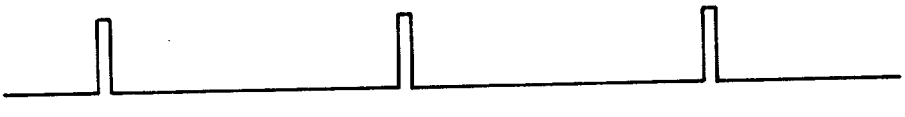
Figure 6E:
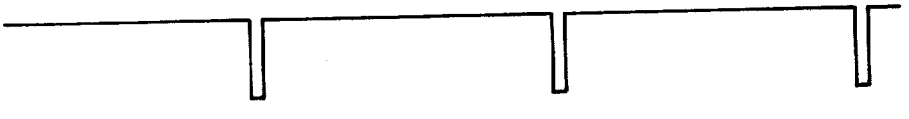
Figure 6F:
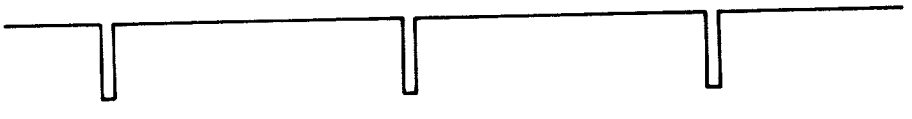

The square-wave control signal, OSC, (FIG. 6*a*) from block 40 is applied to input terminal 102. Inverter 104 inverts OSC, effectively splitting OSC into two signals, the original signal OSC and $\overline{OSC}$ (FIG. 6*c*) which appears at the output of inverter 104. Appropriate time delays are introduced by one-shot multivibrators 106 and 108. Multivibrators 106 and 108 may be so-called 555 ICs readily available commercially in an eight-pin dual inline package (designated differently, depending upon the manufacturer; for example, SN 72555, LM 555, etc.). In the circuit of FIG. 5, multivibrators 106 and 108 are each connected in a standard one-shot multivibrator configuration, with pins 4 and 8 tied to a fixed high DC bias voltage. Timing for multivibrator 106 is provided by the external RC combination of resistor 110 connected to commonly connected pins 6 and 7 and driven by the DC bias voltage, and capacitor 112 connected between pin 6 and ground. Timing for multivibrator 108 is provided by similarly connected resistor 114 and capacitor 116. Pin 1 of each multivibrator is tied directly to ground. Pin 5 is bypassed to ground by capacitor 118 for multivibrator 106 and capacitor 120 for timer 108 to prevent pickup of stray signals.

The undisturbed state for multivibrators 106 and 108 is pin 3 low. When the input to pin 2 goes low, the output at pin 3 goes high and remains high for a period T, the duration of which is determined by the external RC combination in accordance with the relationship $T=0.693$ RC. As the time T expires, the output at pin 3 returns to its undisturbed low state. The output at pin 3 is inverted by inverters 122 and 124 for multivibrators 106 and 108, respectively, and applied as inputs to AND circuits 126 and 128, respectively. Four transition of OSC initiates a trigger signal for one of power transistors 26 and 28 (FIG. 1).

To provide the desired concurrent non-conductive periods for transistors 26 and 28 between switching one OFF and the other ON, a time delay is introduced at the beginning of each half cycle of OSC. This is accomplished in one half cycle by logically ANDing the inverted output of multivibrator 106, $\overline{OSCD}$ with the output of inverter 104 $\overline{OSC}$ and in the other half cycle by logically ANDing the inverted output of multivibrator 108 $\overline{OSCD}$ with OSC.

Signals OSC and $\overline{OSC}$ are coupled to AND circuits 128 and 126, respectively, by race delay networks 130 and 132, respectively. Each race delay network comprises a pair of inverter gates with a capacitor coupled to ground interposed therebetween. These race delay networks introduce slight delays to eliminate race conditions which could otherwise permit both power transistors to be briefly concurrently ON.

The parameters for the circuit components of FIG. 5 are listed in TABLE II.

TABLE II

| | | | |
|---|---|---|---|
| Resistor 110 | 1K | Capacitor 120 | .01 μF |
| Resistor 114 | 1K | Capacitor 130 | .01 μF |
| Capacitor 112 | .05 μF | Capacitor 130a | .1 μF |
| Capacitor 116 | .05 μF | Capacitor 132a | .1 μF |
| Capacitor 118 | .01 μF | | |

For the circuit parameters listed above, the period or pulse width of the delay pulse at pin 3 of each multivibrator is on the order of 1-2 microseconds.

Referring now to FIGS. 6a-6h, to demonstrate circuit operation for the circuit of FIG. 5, control signal OSC (FIG. 6a) from the oscillator control circuit of FIG. 4 is a square-wave oscillating between logical high and low states. As OSC goes low, OSCD (FIG. 6b) goes high providing a logical high pulse of limited duration. This high pulse is inverted by inverter 122 and the resultant signal $\overline{OSCD}$ (FIG. 6e) is ANDed with $\overline{OSC}$ to provide the logic signal $PV_{B1}$ (FIG. 6g) which controls the triggering of transistor 26 (FIG. 1). $\overline{OSC}$ goes high as OSC goes low; however, the low state of $\overline{OSCD}$ prevents $PV_{B1}$ from immediately going high. Thus, $PV_{B1}$ is delayed from $\overline{OSC}$ for the 1-2 microseconds duration of the low $\overline{OSCD}$ pulse. At the end of the low pulse, $\overline{OSCD}$ goes high, permitting $PV_{B1}$ to go high which triggers transistor 26 into its conduction mode. When OSC goes high, $\overline{OSC}$ and consequently $PV_{B1}$ goes low, switching transistor 26 into its OFF or non-conductive mode. As $\overline{OSC}$ goes low, $\overline{OSCD}$, (FIG. 6d), the output of multivibrator 108 generates a high pulse of 1-2 microseconds duration. This pulse is inverted by inverter 124 whose output $\overline{OSCD}$ (FIG. 6f) is ANDed with OSC by AND circuit 128. The low state of $\overline{OSCD}$ holds $PV_{B2}$ low for the duration of the pulse, thereby introducing a delay of 1-2 microseconds before $PV_{B2}$ follows OSC high to trigger transistor 28 into conduction. A comparison of $PV_{B1}$ and $PV_{B2}$ (FIGS. 6g and 6h, respectively) shows the 1-2 microseconds delay at the beginning of each positive going pulse during which both $PV_{B1}$ and $PV_{B2}$ are low holding both transistors 26 and 28 in their non-conductive modes.

Race delay circuits 130 and 132 insure that transitions in $\overline{OSC}$ and OSC do not arrive at AND circuits 126 and 128, respectively, ahead of the pulses from multivibrators 106 and 108, respectively, thereby avoiding race conditions which might otherwise allow both transistors 126 and 128 to be conducting concurrently, a condition which should be avoided.

Figure 7:
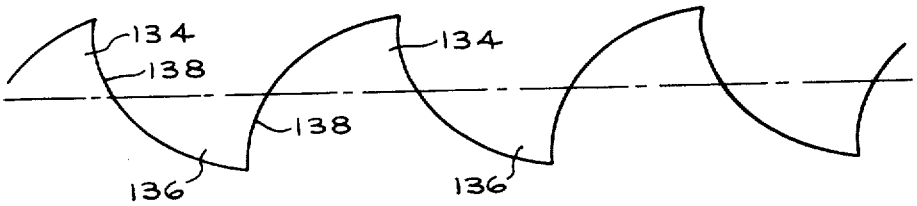
FIG. 7 illustrates a typical waveform of the current in the induction coil of FIG. 1, correlated in time with the signals illustrated in FIGS. 6*a*–6*h*.

FIG. 7 illustrates the alternate current pulses of opposite direction flowing in the coil, with current flow from coil terminal 18 to terminal 22 as viewed in FIG. 1 being defined as positive and current flowing from terminal 18 to terminal 24 being defined as negative for representation purposes in this figure.

Figure 6G:
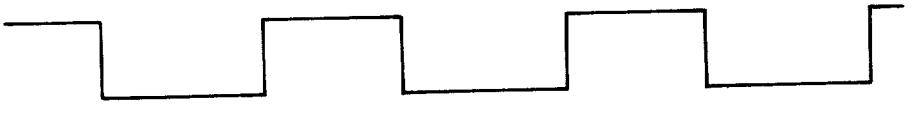
Figure 6H:
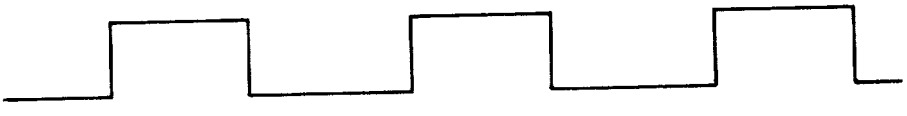

A comparison of FIG. 7 with FIGS. 6G and 6H shows the changes of direction of current in the coil in response to the control signal OSC, which is provided by the circuit of FIG. 4 and divided into a pair of trigger signals $PV_{B1}$ and $PV_{B2}$ by the circuit of FIG. 5. The current pulses 134 depicted as positive in FIG. 7 result when transistor 26 is switched into its conduction mode in response to control signal OSC assuming its low state, i.e., switching from high to low. The pulses 136 depicted as negative occur when transistor 28 is switched into conduction in response to control signal OSC assuming its high state, i.e., switching from low to high. The decaying portions of the pulses designated 138 represent the reverse current flowing in the coil during the momentary time delay between the switching OFF of one transistor and the switching ON of the other.

It is to be understood that the pulse widths shown in FIGS. 6a-6h and FIG. 7 represent only a segment of the current pulse train associated with each 8.3 millisecond cycle of the power signal $V_S$. The variation in pulse width between pulses shown is imperceptible. However, it is to be understood that the pulse width and magnitude of the pulses represented in these FIGURES vary from roughly 25 microseconds to 15 microseconds as the instantaneous voltage $V_s$ varies from the threshold value of roughly 80 Volts to the peak value of 168 volts during each 8.3 millisecond cycle of signal $V_s$. As previously described, this variation in pulse widths is illustrated in exaggerated fashion in FIG. 3.

Figure 8:
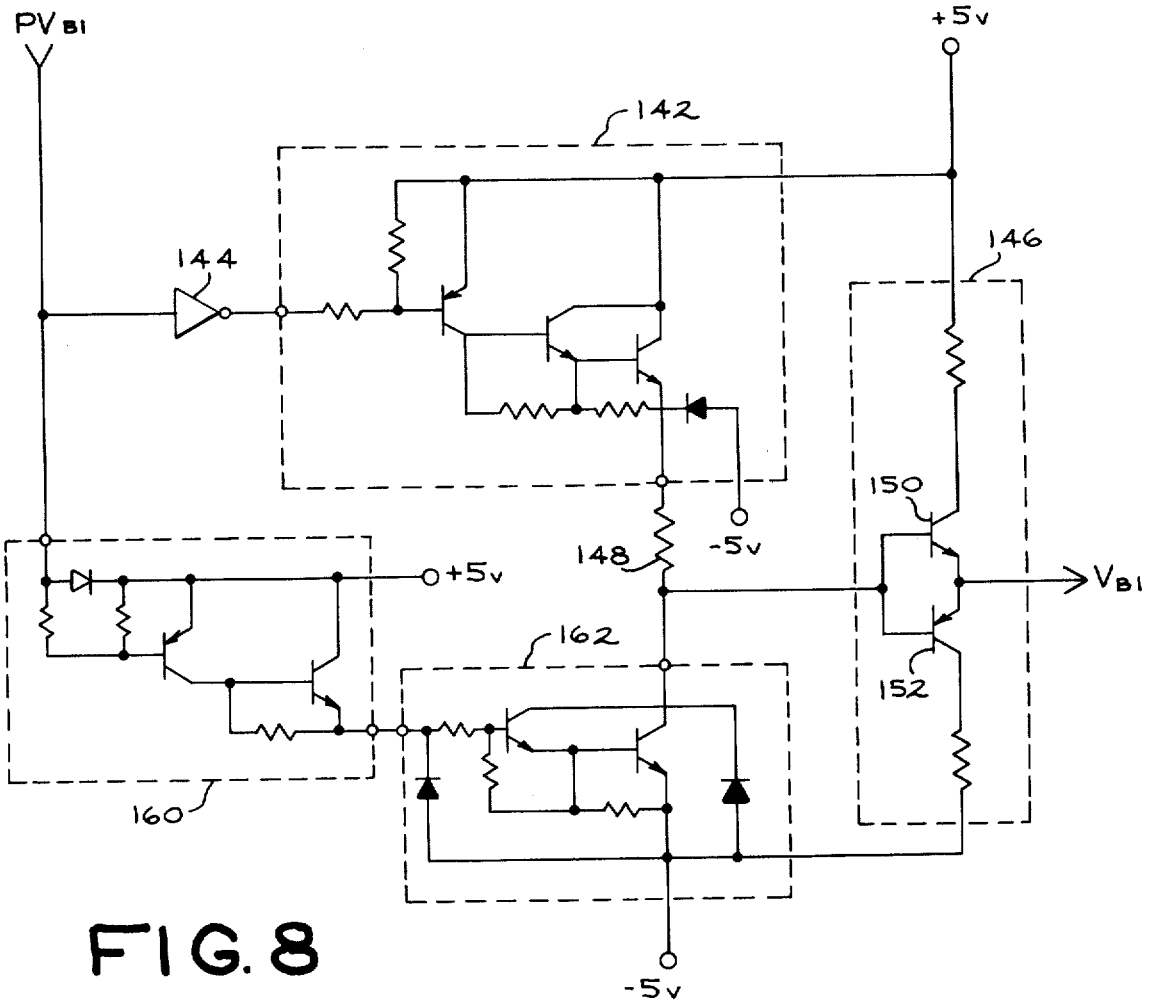
FIG. 8 is a simplified schematic circuit diagram illustrating that portion of the circuitry of block 44 of FIG. 1 associated with one of the transistors of FIG. 1.

FIG. 8 schematically illustrates the amplifier circuitry of block 44 (FIG. 1) for transistor 26. The trigger signal for transistor 26, $PV_{B1}$ from the circuit of FIG. 5 is the input to this circuit. The output signal $V_{B1}$ is a replica of $PV_{B1}$ amplified to provide the necessary power levels for triggering power transistor 26. This pre-amp circuit is designed to provide active ON and active OFF during signals. The ON signal is generated by amplifier circuit 142 which is a standard commercially available IC package (designated S-2580) comprising 8 identical amplifier circuits, only one of the eight amplifiers being shown. While use of one of the available amplifier circuits as shown performs satisfactorily, for greater reliability and component longevity, it may be desirable to connect two or more of these amplifiers in parallel to reduce the power load on the individual amplifiers. Preferably, four of the eight amplifier circuits in the package are tied in parallel for the pre-amp circuit of transistor 26 and the remaining four are similarly used in the pre-amp circuitry for transistor 28 (not shown). $PV_{B1}$ is inverted by inverter 144 and amplified by amplifier 142. The output of amplifier 142 is tied to the base drive of output section 146 via resistor 148.

The OFF signal is generated by amplifier sections 160 and 162. Amplifier 160 may be a six amplifier IC chip readily available commercially (designator UHP-495). As with amplifier 142, a single one of the six available amplifier performs satisfactorily. However, in a preferred form of the circuit, two of the amplifiers are tied in parallel for the driving circuit of each of power transistors 26 and 28. Amplifier 162 is an IC chip readily commercially available (designator ULN 2004). The ULN 2004 chip provides seven identical amplifier circuits on the chip. As with amplifiers 160 and 142, an individual one of the circuits as shown will perform satisfactorily but, in a preferred form, four of the seven amplifiers are tied in parallel for use in driving transistor 26 and the remaining three are similarly tied in parallel for use with transistor 28. The output of amplifier 162 is also tied to the base drive of output section 146.

Output section 146 is an NPN-PNP push-pull circuit with an output signal $V_{B1}$. When $PV_{B1}$ swings high, the output of amplifier 142 switches transistor 150 into conduction to provide a base current on the order of 1.5 amps to transistor 26 (FIG. 1) thereby rapidly switching transistor 26 into conduction. When $PV_{B1}$ swings low, the output from amplifier 162 swings to a negative 5 volts to switch transistor 152 into conduction so as to rapidly deplete the current from the base of power transistor 26 to rapidly switch it out of its conduction mode.

The pre-amp circuitry for driving transistor 28 and its operation is identical to that shown and described in FIG. 8 for transistor 26 and has been omitted for clarity and brevity.

It is apparent from the foregoing description than an induction heating arrangement is provided by the present invention which provides the desired ultrasonic frequency operation of an induction coil energized by a 60 Hz power supply which eliminates the need for large expensive filter capacitors and expensive feedback circuitry associated with the induction heating arrangements of the prior art.

While in accordance with the Patent Statutes a specific embodiment of the present invention has been illustrated and described herein, it is realized that numerous modifications and changes will occur to those skilled in the art. It is therefor to be understood that the appended claims are intended to cover all such modifications and changes as fall within the true spirit and scope of the invention.

What is claimed is:

1. An induction heating arrangement for a cooking appliance comprising:

support means adapted to support a cooking utensil;

an induction heating coil positioned adjacent said support means adapted to inductively couple the cooking utensil supported by said support means to generate heat in the utensil;

power supply means adapted for energization by an external power source for providing a pulsating power signal; and non-resonant push-pull inverter circuit means for controlling the energization of said coil comprising switch means switchable between first and second conduction modes, said switch means being operative in its first conduction mode to couple said power signal to said coil so as to cause current from said power supply means to flow in said coil in one direction and in its second conduction mode to couple said power signal to said coil so as to cause current from said power supply means to flow in said coil in the opposite direction; and control signal generating means operative to generate a control signal which oscillates between a first state and a second state at a frequency which is high relative to the frequency of said pulsating power signal and which is a function of the instantaneous amplitude of said power signal independent of the current flowing in the coil;

said control signal being operative in oscillating between its first and second states to oscillate said switch means between its first and second conduction modes, respectively, thereby causing the direction of current in said coil to change at a frequency which varies as a function of the amplitude of said power signal.

2. The induction heating arrangement of claim 1 wherein said control signal generating means is operative to cause said control signal to oscillate between its first state and its second state at a frequency which varies directly with the amplitude of said power signal.

3. An induction heating arrangement comprising:

an induction heating coil;

power supply means adapted for energization by an external power source for providing a pulsating power signal; and non-resonant push-pull inverter circuit means for controlling the energization of said coil comprising switch means switchable between first and second conduction modes, said switch means being operative in its first conduction mode to couple said power signal to said coil so as to cause current from said power supply means to flow in said coil in one direction and in its second conduction mode to couple said power signal to said coil so as to cause current from said power supply means to flow in said coil in the opposite direction; and control signal generating means operative to generate a control signal which oscillates between a first state and a second state at a frequency which is high relative to the frequency of said pulsating power signal, said control signal frequency varying directly with the amplitude of said power signal independent of the current flowing in said coil;

said control signal being operative in oscillating between its first and second states to oscillate said switch means between its first and second conduction modes, respectively, thereby causing the direction of current in the coil to change at a frequency which varies with the amplitude of said power signal.

4. An induction heating arrangement comprising:

an induction heating coil;

power supply means adapted for energization by an external alternating current power source for providing a pulsating power signal; and non-resonant push-pull inverter circuit means for controlling energization of said coil comprising switch means having a first conduction mode, a second conduction mode, and a non-conduction mode, said switch means being operative in its first conduction mode to cause current from said power supply means to flow in said coil in one direction, in its second conduction mode to cause current from said power supply means to flow in said coil in the opposite direction, and in its non-conduction mode to prevent current flow in said coil; and control signal generating means operative to generate a control signal having a first state, and a second state, said control signal oscillating between said first state and said second state when the amplitude of said power signal is greater than a predetermined threshold value at a frequency which is high relative to the frequency of said power signal, said control signal frequency varying with said amplitude independent of the current in said coil, said control signal assuming a non-oscillating state when the amplitude of said power signal is less than said threshold value;

said switch means being responsive to said control signal generating means and operative to oscillate between its first and second conduction modes as said control signal oscillates between its first and second states, respectively, and to assume its non-conduction mode when said control signal is in its non-oscillating state, thereby causing the direction of current in said coil to oscillate at the frequency of said control signal when said amplitude of said power signal exceeds said threshold level and to prevent current flow in said coil when said power signal amplitude is below said threshold level.

5. The induction heating arrangement of claims 1, 3 or 4 wherein said coil comprises a winding having first and second end terminals and a tap terminal therebetween and said switch means comprises first and second electronic switches, said first and second electronic switches coupling said first and second terminals respectively to said power means, said first switch being operative when switched into conduction to enable current to flow in said coil between said first end terminal and said tap terminal in said one direction, and said second switch being operative when switched into conduction to enable current to flow in said coil in said opposite direction, between said second end terminal and said tap terminal, said first switch being switched into conduction in response to said control signal assuming its first state and said second switch being switched into conduction in response to said control signal assuming its second state.

6. The induction heating arrangement of claim 5 wherein said control signal generating means comprises voltage controlled oscillator means operative to cause said control signal to oscillate between its first and second states at a frequency which varies directly and essentially linearly with the amplitude of said power signal.

7. The induction heating arrangement of claims 2, 3 or 4 wherein said control signal generating means comprises voltage controlled oscillator means operative to cause said control signal to oscillate between its first and second states at a frequency which varies directly and essentially linearly with the amplitude of said power signal.

8. An induction heating arrangement for a cooking appliance comprising:

an induction coil;

power supply means adapted for energization by an external power source and operative to provide a pulsating power signal; and non-resonant push-pull inverter circuit means for coupling said power signal to said coil comprising switch means switchable between a first conduction mode in which current from said power supply means is caused to flow in said coil in one direction and a second conduction mode in which current from said power supply means is caused to flow in said coil in the opposite direction; and means for generating a control signal which oscillates between a first state and a second state at a frequency which is high relative to the frequency of said power signal, said frequency of oscillation varying as a function of the amplitude of said power signal;

said control signal being coupled to said switch means and operative to switch said switch means between its first and second conduction modes as said control signal oscillates between its first and second states, respectively, thereby supplying current pulses of opposite direction alternately to said coil, the amplitude and pulse rate of said current pulses varying directly with the amplitude of said power signal and the duration of said current pulses varying inversely with the amplitude of said power signal whereby the energy delivered to said coil by each current pulse is substantially uniform from pulse to pulse.

9. An induction heating arrangement for a cooking appliance comprising:

power supply means adapted for energization by an external power source and operative to provide a pulsating power signal;

an induction heating coil having first and second end terminals and a tap terminal therebetween; and non-resonant push-pull inverter circuit means for controlling energization of said coil, adapted to alternately couple said power signal to said first and second terminals of said coil such that pulsations of current of opposite direction alternately flow in said coil, the current pulse repetition rate being high relative to the frequency of power supply, said pulse repetition rate and the amplitude of each current pulse varying directly with the amplitude of said power signal, and the pulse width of each current pulse varying inversely with the amplitude of said power signal whereby the energy delivered to the coil by each current pulse is substantially uniform from pulse to pulse.

10. An induction heating arrangement for a cooking appliance comprising:

an induction heating coil having first and second end terminals and a tap terminal therebetween;

power supply means adapted for energization by an external power source and operative to provide a pulsating power signal; and non-resonant push-pull inverter circuit means for coupling said power signal to said coil comprising: first switch means electrically connected between said power supply means and said first end terminal; and second switch means electrically connected betwen said power supply means and said second end terminal; said switch means having a first conduction mode in which said first switch means is conductive and said second switch means is non-conductive, thereby causing current from said power supply means to flow in one direction relative to said coil between said tap terminal and said first terminal, and a second conduction mode in which said first switch means is non-conductive and said second switch means is conductive, thereby causing current from said power supply means to flow in the opposite direction relative to said coil between said tap terminal and said second terminal;

and means for switching said switch means between its first and second conductive modes at a rate which is high relative to the frequency of said pulsating power signal and which varies as a function of the instantaneous amplitude of said power signal independently of the current in said coil, thereby alternately providing pulses of current of opposite direction in said coil at a pulse rate and with a pulse duration which varies as a function of the instantaneous amplitude of said power signal.

11. The induction heating arrangement of claim 10 wherein said means for switching said switch means comprises control signal generating means operative to generate a control signal which oscillates between a first state and a second state at a frequency which is high relative to the frequency of said power signal, said control signal being operative in oscillating between its first and second states to oscillate said switch means between its first and second conduction modes, respectively; said control signal generating means including means responsive to said power signal for varying the frequency of oscillation of said control signal as a function of said power signal amplitude.

12. The induction heating arrangement of claim 11 wherein said means responsive to said power signal comprises a voltage controlled oscillator responsive to said power signal and operative to vary said control signal frequency directly with said power signal amplitude.

* * * * *

UNITED STATES PATENT AND TRADEMARK OFFICE

CERTIFICATE OF CORRECTION

PATENT NO. : 4,473,732

DATED : September 25, 1984

INVENTOR(S) : Thomas R. Payne

It is certified that error appears in the above-identified patent and that said Letters Patent is hereby corrected as shown below:

Claim 5, Line 19, after "power" insert --supply--.

Signed and Sealed this

*Nineteenth* Day of *February 1985*

[SEAL]

*Attest:*

DONALD J. QUIGG

*Attesting Officer* *Acting Commissioner of Patents and Trademarks*